United States Patent [19]

Smith

[11] 4,440,009

[45] Apr. 3, 1984

[54] REKEYABLE LOCK METHOD AND APPARATUS

[75] Inventor: Jerry R. Smith, Littleton, Colo.

[73] Assignee: Innovative Research Corporation, Littleton, Colo.

[21] Appl. No.: 327,787

[22] Filed: Dec. 7, 1981

[51] Int. Cl.[3] ..... E05B 25/00

[52] U.S. Cl. ..... 70/385; 70/383; 70/340

[58] Field of Search ..... 70/337, 338, 340, 341, 70/342, 343, 382, 383, 385

[56] References Cited

U.S. PATENT DOCUMENTS

| | | | |
|---|---|---|---|
| 1,650,568 | 11/1927 | Hurd | 70/338 |
| 3,070,987 | 1/1963 | Baker | 70/383 |
| 3,073,146 | 1/1963 | Patriquin | 70/383 |
| 3,078,705 | 2/1963 | Morrison | 70/383 |
| 3,125,878 | 3/1964 | Gutman | 70/341 |
| 3,175,378 | 3/1965 | Russell | 70/383 |
| 3,563,071 | 2/1971 | Barger | 70/383 |

*Primary Examiner*—Robert L. Wolfe

*Attorney, Agent, or Firm*—Young & Martin

[57] ABSTRACT

A rekeyable cylinder lock includes removeable spacers between top and bottom tumbler pins, and a key bit device for removing a spacer from the pin chamber through the key way. The key bit device includes bitting thereon to position the spacer in the top pin chamber and a cut in the opposite side thereof adapted to capture the spacer from the top pin chamber and remove it from the lock. In another embodiment of the invention, a key bit device is provided for placing a spacer into a pin chamber of the lock to rekey the lock. It includes a mechanism, such as a spring, in a cut on the back side of the key bit that is adapted to force a spacer out of the cut and into the pin chamber in the lock.

8 Claims, 15 Drawing Figures

REKEYABLE LOCK METHOD AND APPARATUS

BACKGROUND OF THE INVENTION

The present invention is related to locks and more specifically to a method and apparatus for rekeying cylinder locks with tumbler pins without having to disassemble the lock apparatus.

The most common type of lock in use at the present time, particularly on door latches in buildings, is the tumbler pin lock. Such a lock usually includes a lock cylinder housing with a cylindrical bore extending longitudinally therethrough, a cylindrical core positioned rotatably in the bore and having a longitudinal keyway therein for receiving a key bit. A plurality of top pin chambers are positioned in the cylinder housing perpendicular to and extending radially outward from the cylindrical bore, and correspondingly spaced bottom pin chambers are positioned in the core. Top pins are generally positioned in the top pin chambers, and bottom pins are generally positioned in the bottom pin chambers, although top pins can move partially into bottom chambers and bottom pins can move partially into top chambers when the core is rotated to align corresponding top and bottom chambers with each other. In fact, a pin positioned partially in a top pin chamber and partially in a bottom pin chamber across the shear plane between the cylinder housing and the rotatable core prohibits the core from being rotated and provides the locking effect of the lock mechanism.

Typically, the lengths of the individual bottom pins are selected to establish the keying requirements of the lock. In order for a key to open the lock, it must have a key bit with bitting and spacing thereon cut to correspond inversely to the bottom pin lengths. The fitting must be cut and spaced such that when the key is inserted into the keyway the bitting acts on the bottom pins to align all of the interfaces between the top pins and bottom pins respectively with the shear plane between the core and the cylinder housing. When all of the interfaces between the top and bottom pins are aligned with the shear plane, the core can be turned to operate a lock or latch mechanism. However, if a properly cut key bit is not positioned in the core, at least one top tumbler pin is positioned across the shear plane, and the core cannot be rotated within the cylinder housing.

Master key arrangements are also available in such conventional cylinder locks. For example, a plurality of cylinder locks can be provided, each lock having a separate keying arrangement that requires a unique key bit to open the lock, as well as being openable by a common master key that is capable of opening all of the locks in the set. Such master key lock devices are basically of the same construction as that described above, with the exception that master wafers or spacers are positioned between one or more of the top and bottom pin sets to provide more than one interfacing surface for alignment with the shear plane. For example, one master wafer positioned between a top and a bottom pin in such a lock provides one potential interface at the top of the wafer and another potential interface at the bottom of the wafer. The master key can be provided with bitting and spacing to align the interface at the bottom of the master wafer with the shear plane in order to rotate the core, and a different individual key can be provided with bitting and spacing to align the interface at the top of the wafer with the shear plane to also rotate the core.

When one desires to rekey such conventional cylinder locks, the cylinder and core must be disassembled, the bottom pins removed and replaced with a different set of bottom pins of different selected lengths. Such a process is time consuming and usually requires the services of a locksmith to perform properly. Unfortunately, there are situations in which rekeying is required quite often. For example, in apartments and office buildings, there may be frequent turnover of tenants, which requires frequent lock changes. In some other security applications, locks are changed periodically as a matter of policy. In such applications, the cost of rekeying can be a significant expense. A method and apparatus of rekeying such locks easily and without disassembly could substantially reduce the cost and inconvenience of rekeying locks.

SUMMARY OF THE INVENTION

Accordingly, it is an object of the present invention to provide a novel rekeyable cylinder lock apparatus that can be rekeyed by unskilled persons and without requiring disassembly of the lock.

It is also an object of the present invention to provide a cylinder lock apparatus that can be rekeyed a preselected number of times for use with a set of precut keys.

Another object of the present invention is to provide a key bit device that can be used to rekey a lock tumbler pin type cylinder lock that has spacer wafers positioned between sets of top and bottom tumbler pins.

A still further object of the present invention is to provide a method of rekeying a cylinder lock provided with top and bottom tumbler pins without having to disassemble the lock.

In the rekeyable lock apparatus of the present invention, at least one spacer member, preferably in the form of a master wafer, is positioned in the bottom pin chamber between the top and bottom pins for providing two separate interfaces between the top and bottom pins, each of which interfaces is adapted for alignment with the shear plane between the core and the cylinder housing. A device is also provided for removing the spacer member from the pin chamber and ejecting it out of the lock apparatus. The removal device preferably includes an elongated key bit adapted for insertion into the keyway and having bitting thereon adapted to move the spacer member into the top pin chamber and position it with the interface between the spacer member and the bottom pin aligned with the shear plane so that the core can be rotated within the cylinder housing. The key bit is also provided with a cut therein opposite the bitting and of a depth corresponding to the thickness of the spacer member. The cut is adapted to receive the spacer member therein when aligned with the top pin chamber in which the spacer member is positioned by the key bit. When the spacer member is captured in the cut, the key bit can remove it from the pin chamber and carry it out of the core as the key bit is withdrawn from the core.

The rekeyable lock apparatus can also include a plurality of rekeying combinations. One or more spacer member can be positioned in all or selected ones of the pin chambers between the top and bottom pins therein. A corresponding number of keys can be provided with each key bit having bitting thereon adapted to position selected ones of the spacer members into the top pin chambers. Each of said keys, of course, would also be provided with a cut on the opposite side of each key bit spaced to correspond to the bitting and the pin chamber from which the spacer member is desired to be removed. Also, a set of useable keys can be provided for individual use without the cuts on the opposite sides of the key bits, but with appropriate bittings thereon to operate the lock according to the keying arrangements resulting from each rekeying operation.

The method of rekeying a cylinder lock apparatus according to the present invention includes the steps of inserting into the keyway of a cylinder lock a key bit having bitting thereon adapted to position the spacer member into the top pin chamber such that the bottom surface of the spacer member is aligned with the shear plane and wherein the key bit has a cut therein opposite the bitting of a depth corresponding to the thickness of the spacer member, rotating the key bit and core in the housing to align the cut with the top pin chamber and allowing the spacer member to move out of the top pin chamber and into the cut, rotating the key bit and core again with the spacer member captured in the cut to remove the spacer member from the pin chamber and to align the top pin chamber with the bottom pin chamber again, and removing the key bit from the core with the spacer member captured in the cut to extract the spacer member from the lock apparatus.

This invention also includes a rekeying device adapted for rekeying the lock by inserting a spacer member into a pin chamber between a set of upper and lower pins without disassembling the lock. In addition to a key bit with a cut therein opposite the bitting as described above, it includes a device in the cut for forcing the spacer member out of the cut and into the top pin chamber. One example of such a device is a spring member positioned in the cut which has an inherent strength greater than the strength of the spring in the top pin chamber above the top tumbler pin in the lock. With such a device, a spacer member can be positioned in the cut, inserted into the keyway along with the rekeying device, and turned into alignment with the pin chamber. At that point the spring in the cut forces the spacer member out of the cut and into the pin chamber to rekey the lock. Then the rekeying device can be removed from the keyway.

BRIEF DESCRIPTION OF THE DRAWINGS

Other objects, advantages and capabilities of the present invention will become more apparent as the description proceeds, taken in conjunction with the following drawings, in which.

DETAILED DESCRIPTION OF THE PREFERRED EMBODIMENT

Figure 1:
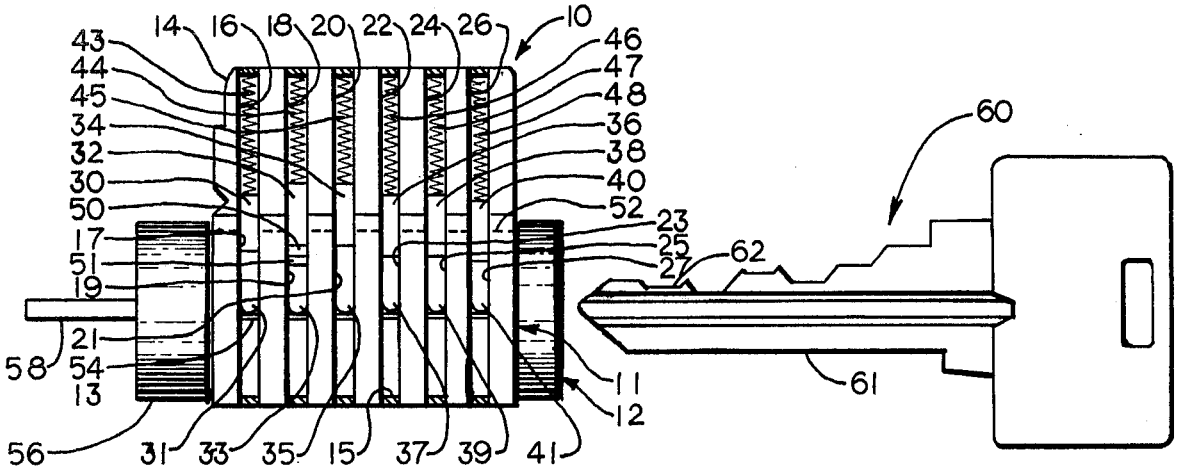
FIG. 1 is a side elevation view with slots in front of each pin chamber cut away to reveal the tumbler pins therein and showing two spacer members positioned between the top and bottom pins in the second pin chamber, with a key bit positioned at the entrance of the keyway in the core and having bitting thereon adapted to open the lock.
Figure 2:
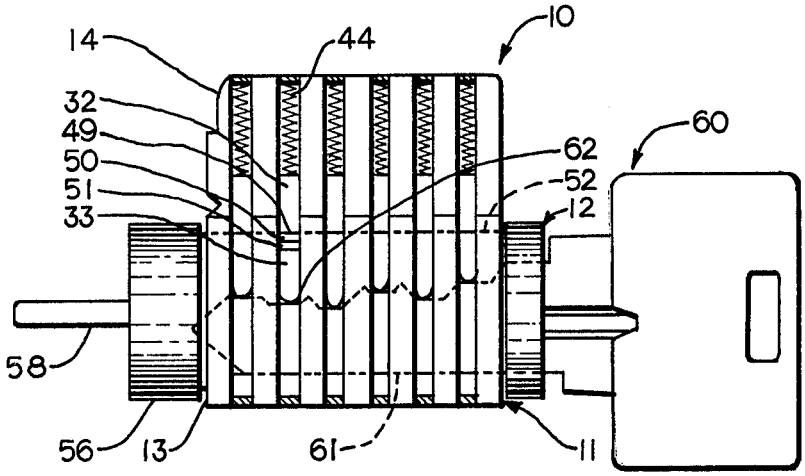
FIG. 2 is a side elevation view of the cylinder lock with slots cut away to show the pin chambers with the key bit positioned in the keyway to operate the lock.

A rekeyable lock cylinder 10 according to the present invention is shown in FIGS. 1 and 2 with a conventional key 60 adapted to open the lock. The cylinder lock 10 is shown in elevation in these figures with strips or slots of the cylinder housing 11 and core 12 cut away to reveal the pin chambers therein for clarity. These components will be described in more detail below.

A substantial portion of the structure shown is conventional for cylinder type locks and will be described first for purposes of background and clarity in presenting the improvements of this invention. The cylinder housing 11 has a lower portion 13 and an upper portion 14. A cylindrical core 12 is rotatably positioned in a cylindrical bore 15 in the lower portion 13 of the cylinder housing 11. A retainer 56 is attached to the rear end of the core 12 for retaining the core 12 in the cylinder housing 11 and for attaching a tail piece 58 to the core 12. The tail piece 58 is a mechanical linkage adapted for engagement with any latch mechanism, such as a door latch, intended to be locked or opened by the lock 10.

The upper portion 14 of the cylinder housing 11 includes a plurality of vertical top pin chambers 16, 18, 20, 22, 24, 26 therein positioned in spaced apart relation to each other in a common plane and extending radially outward from the cylindrical bore 15. Elongated top tumbler pins 30, 32, 34, 36, 40 are slideably positioned in respective top pin chambers 16, 18, 20, 22, 24, 26. Each top tumbler pin 30, 32, 34, 36, 38, 40 is preferably, but not necessarily, the same length as the others. Compression springs 43, 44, 45, 46, 47, 48 are positioned in respective top pin chambers 16, 18, 20, 22, 24, 26 above the respective top tumbler pins 30, 32, 34, 36, 38, 40 therein to bias these top tumbler pins downwardly toward the core 12.

The core 12 also has a plurality of bottom pin chambers 17, 19, 21, 23, 25, 27 extending radially from the peripheral surface of the core 12 into the keyway. The bottom pin chambers 17, 19, 21, 23, 25, 27 are all in a common plane and spaced to align with the respective corresponding top pin chambers 16, 18, 20, 22, 24, 26 when the core 12 is rotated to the upright position as shown in FIGS. 1 and 2. Elongated bottom tumbler pins 31, 33, 35, 37, 39, 41 are slideably positioned in respective bottom pin chambers 17, 19, 21, 23, 25, 27. Unlike the top tumbler pins, however, the bottom tumbler pins are usually of different lengths, the combination of the lengths of the bottom pins determining the keying of the lock. When there is not a key in the keyway, the lower end of the bottom tumbler pins 31, 33, 35, 37, 39, 41 rest on the ledge 54 in the keyway, and the top tumbler pins 30, 32, 34, 36, 38, 40 are positioned across the shear line 52 between the core 12 and the cylinder housing 11. When any one of the top or bottom pins is positioned across the shear line 52, the core 12 cannot be turned and the lock cannot be opened. However, when the tumbler pins are positioned so that none of the pins are positioned across the shear line 52, as shown in FIG. 2, the key 60 can be turned and the lock can be opened.

As shown in FIG. 2, the key bit 61 of key 60 is inserted in the keyway in the core 12. The bitting on the key bit 61 are cut and spaced corresponding to the length of the respective bottom pins 31, 33, 35, 37, 39, 41 such that the interfaces between the corresponding top pins and the bottom pins all align with the shear plane 52. In this configuration as shown in FIG. 2, rotor 12 can be turned and the lock can be opened with key 60.

Figure 3:
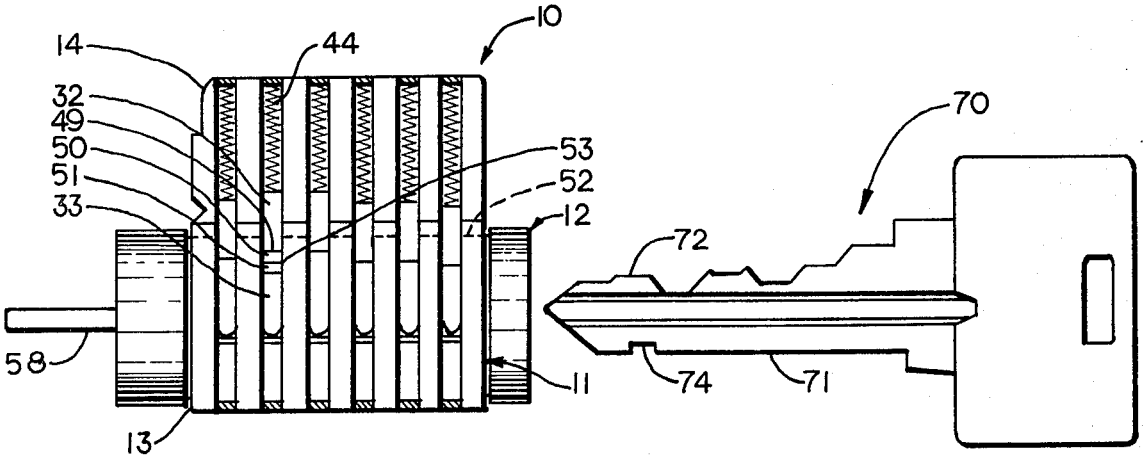
FIG. 3 is a side elevation view with slots cut away to reveal the pin chambers therein and showing the rekeying device in the form of a key bit with a cut therein opposite the bitting for capturing a spacer member.

In order to provide rekeying capability according to this invention, removable spacers are positioned between one or more of the top and bottom tumbler pin sets in the lock. For example, as shown in FIGS. 1 through 3, two spacer members 50, 51 in the form of thin, cylindrical wafers are positioned between top pin 32 and bottom pin 33 in the second pin chamber. As best seen in FIG. 2, the first conventional key 60 has a bitting 62 in the second position thereon cut to position the interface 49 between the top pin 32 and wafer 50 in alignment with shear plane 52. The bitting also positions the interfaces between the remaining top and bottom pin sets in alignment with the shear plane 52 in the conventional manner so that the core 12 can be turned and the lock opened.

As shown in FIG. 3, a special key 70 is provided for rekeying the lock 10 by removing wafer 50 without disassembling the lock. The bit 71 of the special rekeying key 70 is provided with a bitting 72 in the second position thereof which is higher then the corresponding bitting 62 of the original key 60. The remaining bittings of the special rekeying key 70 are the same as the corresponding bittings of conventional key 60. On the opposite side of the key bit 71, a cut 74 is provided therein of a depth approximately equal to the thickness of wafer 50.

Figure 4:
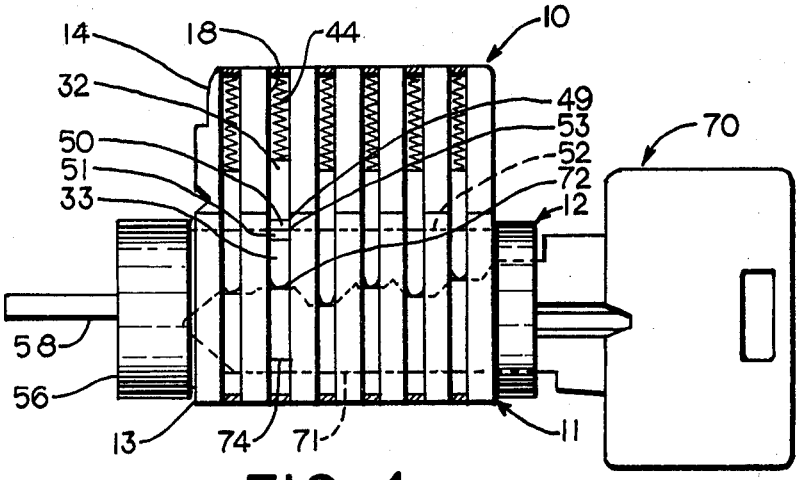
FIG. 4 is a side elevation view of the cylinder lock showing the rekeying device positioned in the core.

Referring now to FIG. 4, key bit 71 of rekeying key 70 is shown inserted into the keyway in core 12. Bitting 72 in the second position of key bit 71 is of a sufficient height to position wafer 50 in the top pin chamber 18 with the lower surface or interface 53 thereof aligned with shear plane 52. The remaining bittings are the same as those on key 60, i.e., of such respective heights to position the interfaces between the other top and bottom pin sets in alignment with shear plane 52 also. Therefore, in the position shown in FIG. 4, the rekeying key 70 can be used to rotate core 12 within cylinder housing 11 180° to the position shown in FIG. 5.

Figure 5:
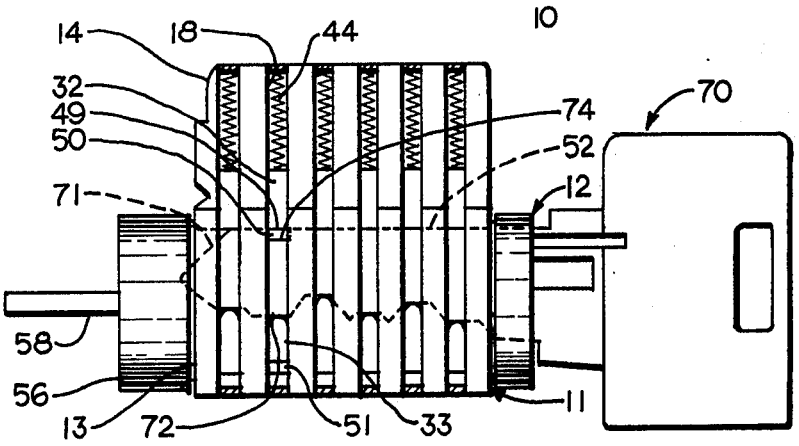
FIG. 5 is a side elevation view of the cylinder lock with the rekeying device positioned in the core and turned 180° to capture the spacer member in the cut therein.
Figure 6:
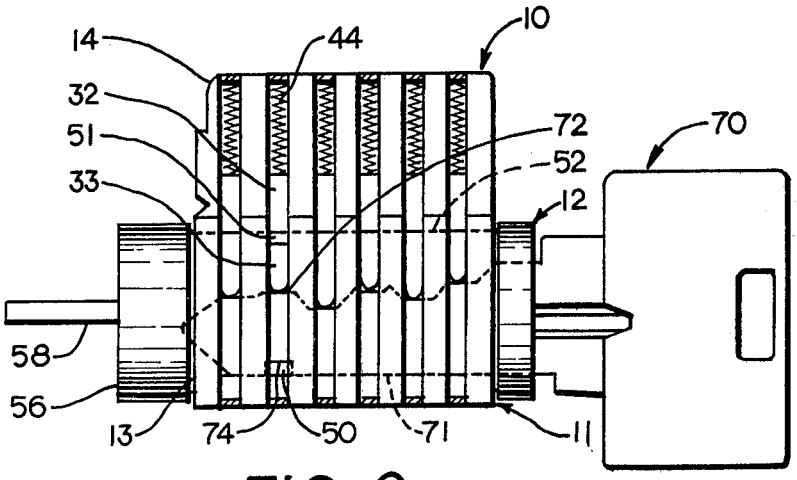
FIG. 6 is a side elevation view of the cylinder lock with the rekeying device positioned therein and rotated again to the normal position with the spacer member captured in the cut and removed from the pin chamber.

With the rekeying key 70 and core 12 rotated 180° to the position shown in FIG. 5, all of the bottom pins, including bottom pin 33 and wafer 51, positioned in core 12 are rotated away from the top pin chambers. At the same time, cut 74 is rotated to a position in alignment with top pin chamber 18. When cut 74 is aligned with top pin chamber 18, spring 44 pushes such wafer 50 out of top pin chamber 18 and into cut 74. Since the depth of cut 74 is approximately equal to the thickness of wafer 50, the interface 49 between top pin 32 and wafer 50 is aligned with shear plane 52. Therefore, the shear plane 52 remains uninterrupted and the rekeying key 70 can be rotated back 180° to the position shown in FIG. 6. The configuration shown in FIG. 6 is substantially the same as the configuration shown in FIG. 4, with the exception that wafer 50 is captured in the cut 74 and is removed from its former position under top pin 32.

Figure 7:
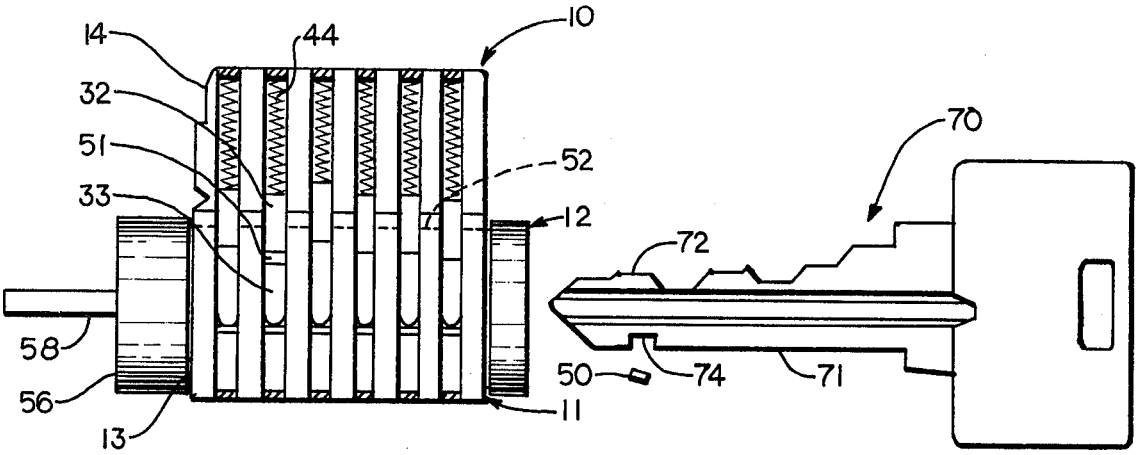
FIG. 7 is a side elevation view of the cylinder lock with the rekeying device removed from the keyway in the core and with the spacer member also removed from the lock.

As shown in FIG. 7, the key bit 71 of key 70 can then be pulled out of the keyway in core 12. As the key bit 71 is removed from core 12, the wafer 50 is also pulled out of the keyway by cut 74 and can be discarded. Therefore, only wafer 51 remains positioned between top pin 32 and bottom pin 33 as shown in FIG. 7. The effect of the removal of wafer 50 as described above is that the lock is rekeyed.

Figure 8:
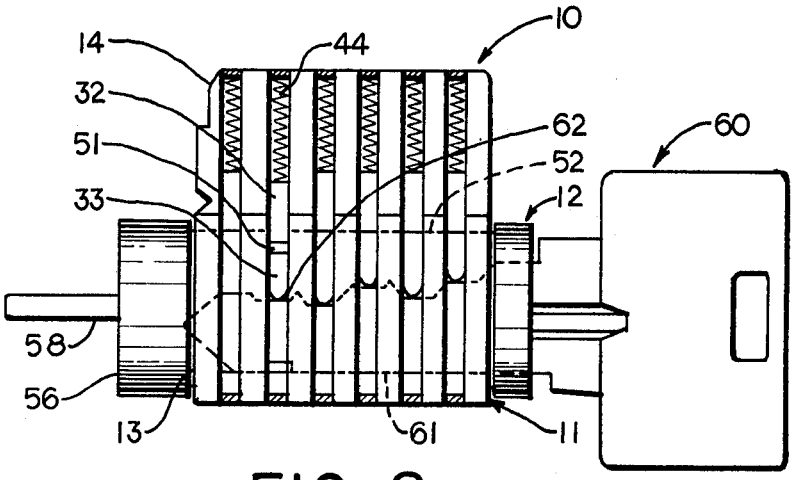
FIG. 8 is a side elevation view of the lock device with the first spacer member removed from the pin chamber and showing the original key positioned in the core to illustrate that after the rekeying operation is completed, the original key is incapable of opening the lock.

To illustrate the effect of the rekeying by removal of wafer 50, FIG. 8 shows the original key 60 again inserted into the core 12. As shown in FIG. 8, bitting 62 of the original key 60 is now of an insufficient height to push bottom pin 33 upward for enough to align an interface with shear plane 52. Therefore, top pin 32 is positioned across shear plane 52 and the core 12 can no longer be turned by the original key 60. Of course, a key with the same bitting as key 70, but not including cut 74, would still be operative to turn the core 12 and open the lock.

Figure 9:
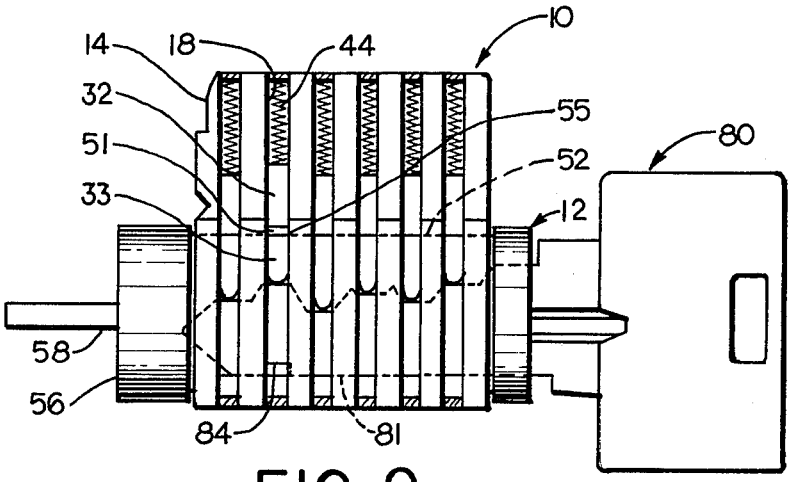
FIG. 9 is a side elevation view of the cylinder lock with a second rekeying device positioned in the core.
Figure 10:
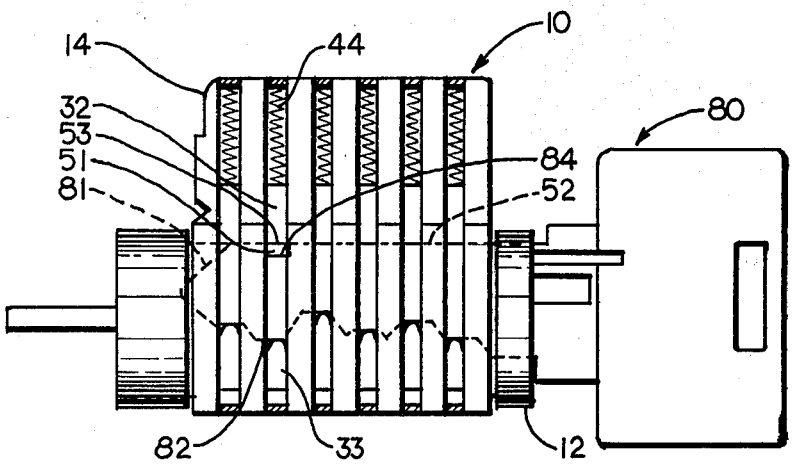
FIG. 10 is a side elevation view of the lock with the second rekeying device rotated 180° to capture the second spacer member therein.
Figure 11:
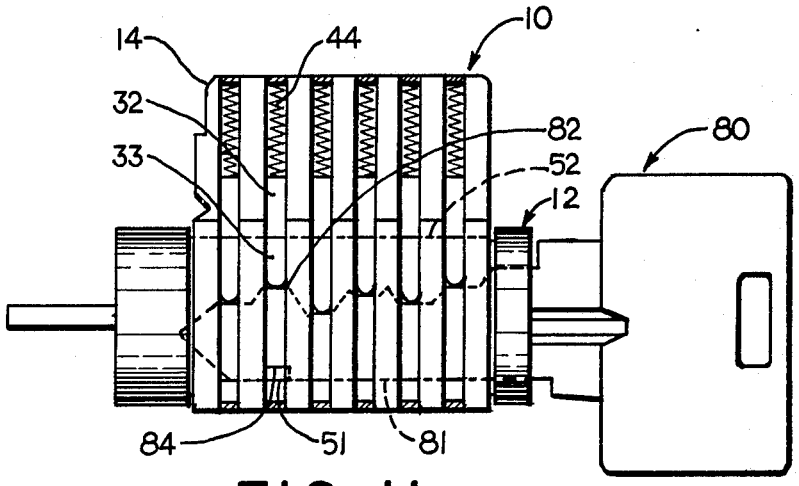
FIG. 11 is a side elevation view of the cylinder lock with the second rekeying rotated again to the normal position with the second spacer member removed from the pin chamber and captured in the cut in the key bit thereof.
Figure 12:
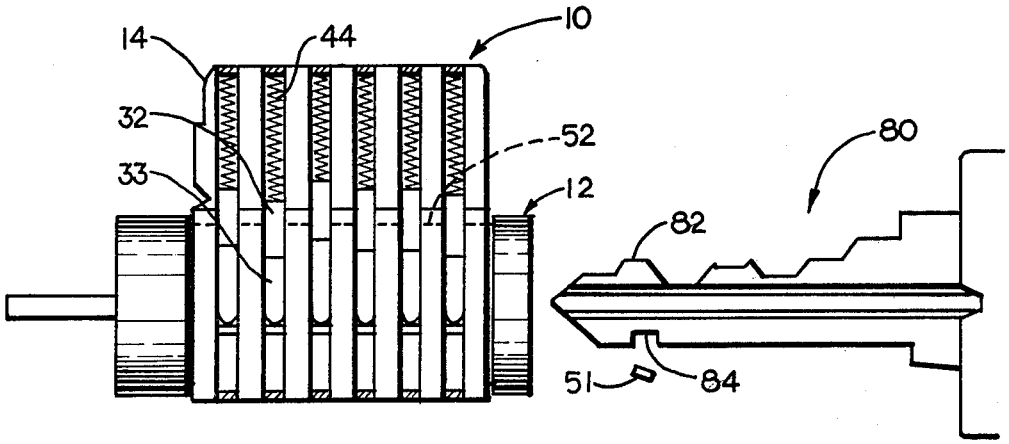
FIG. 12 is a side elevation view of the cylinder lock showing the second rekeying device removed from the keyway and showing the second spacer member also removed from the lock so that it is rekeyed the second time.

As shown in FIGS. 9 and 10, the lock 10 can be rekeyed again to a still different configuration by the use of a second rekeying key 80. Key bit 81 of rekeying key 80 is provided with a still higher bitting 82 in the second position, which is effective to position wafer 51 into the top pin chamber 18. The bottom surface of wafer 51, i.e., interface 55, is now aligned with shear plane 52. A cut 84 is provided in the opposite side of key bit 81 to capture wafer 51 when the core 12 is rotated 180° as shown in FIG. 10. Of course, as described above for key 70, with the wafer 51 captured in cut 84 and interface 53 aligned with shear plane 52, the rotor 12 can be turned back 180°, as shown in FIG. 11 to remove wafer 51 from the pin chambers. Then, as shown in FIG. 12, the rekeying key 80 can be withdrawn from the core 12 to pull wafer 51 out of the lock to effect a second rekeying of the lock 10.

With the principle structure thus explained and illustrated, it is not necessary to further illustrate that a large number of rekeying sequences can be effected by the principle of this invention. A plurality of up to 4 or 5 individual wafers can be positioned in each or any number of selected ones of the lower pin chambers 17, 19, 21, 23, 25, 27 in conventional cylinder locks. A rekeying master key can then be provided with appropriate bitting thereon for removal of one each of the individual wafers at a time. Each such removal of a wafer would result in rekeying the lock. For example, if each of the six bottom pin chambers 17, 19, 21, 23, 25, 27 was provided with two wafers apiece and respective corresponding rekeying keys, the lock 10 could be rekeyed 12 times according to the method of this invention without requiring disassembly of the lock or changing tumbler pins.

It should also be mentioned that the apparatus and method of this invention is conducive to the use of a master key that is capable of opening the lock with any of the selected key combinations by providing bitting thereon of appropriate heights to position the top surfaces of all the bottom pins in alignment with shear plane 52. Also, intermediate master keys can also be provided which position the top surface of one or more of the wafers in alignment with shear plan 52. Then, as a latter stage of evolution, with the appropriate master rekeying key, the lock could be rekeyed so that even such an intermediate master key would no longer be effective to open the lock.

Figure 13:
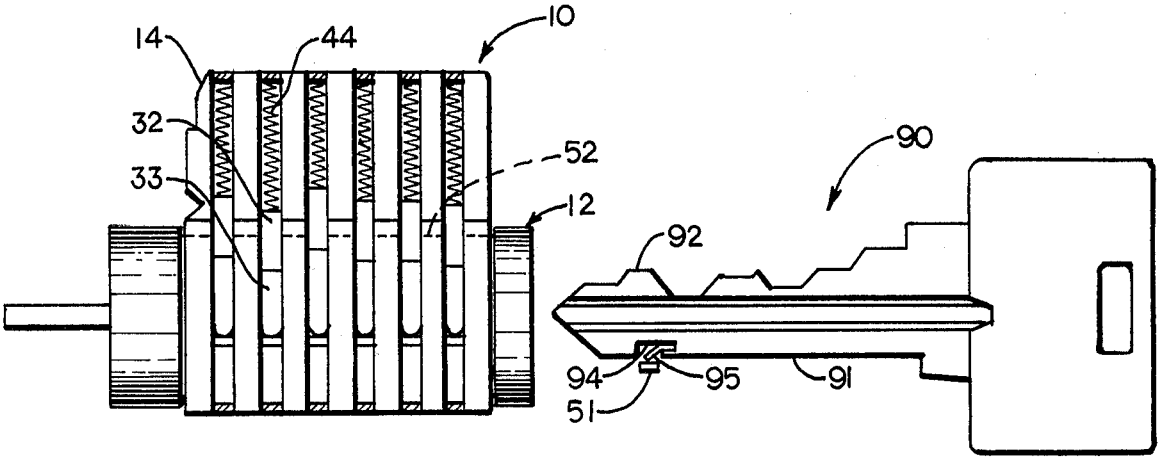
FIG. 13 is a side elevation view of the cylinder lock and a third rekeying device adapted for inserting a spacer member into the pin chamber of the lock.
Figure 14:
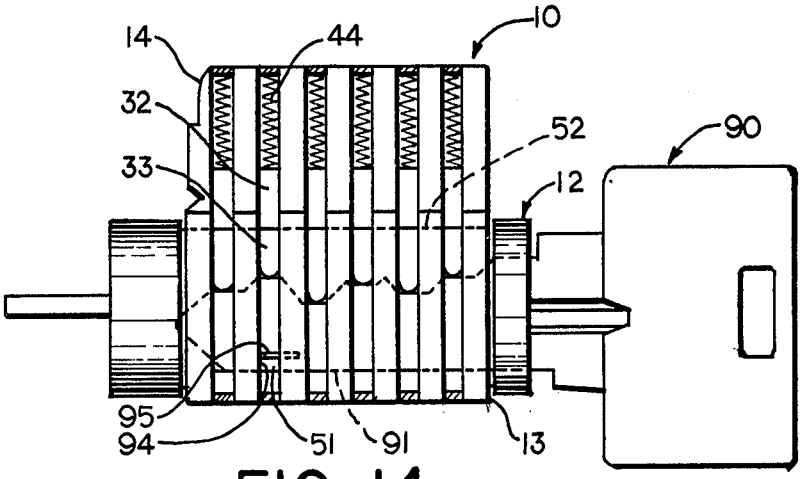
FIG. 14 is a side elevation view of the cylinder lock showing the third rekeying device inserted into the core in an intermediate step of placing a spacer member into the lock.
Figure 15:
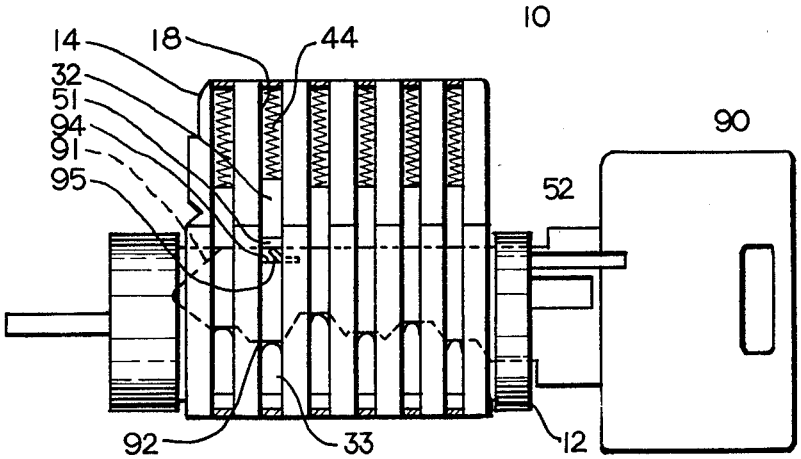
FIG. 15 is a side elevation view of the cylinder lock illustrating the insertion of a spacer member into an upper pin chamber of the lock to accomplish rekeying the lock.

In another embodiment of this invention, as shown in FIGS. 13 through 15, a rekeying device 90 is provided that can be used to rekey the lock by inserting spacer members back into the pin chambers in the lock. The rekeying device 90 has a key bit 91 with bitting thereon adapted to open the lock, i.e., align the interfaces under the top pins with the shear line 52 so the core 12 can be turned. Again, the description here is focused on rekeying the second tumbler pin set position, although the same principle applies to rekeying any other pin set or combinations of pin sets in the lock.

The second position bitting 92 is of sufficient height to push top pin 32 and bottom pin 33 upwardly such that lower surface of top pin 32 aligns with shear plane 52. A cut 94 in key bit 91 opposite bitting 92 has a leaf spring 95 mounted therein and is adapted to receive therein a spacer member 51 against the bias of the spring 95, as shown in FIG. 13. The leaf spring 95 has more inherent bias strength than the pin springs in the lock for purposes described more fully below. When the spacer member 51 is positioned in the cut 94 and inserted into the keyway in core 12, as shown in FIG. 14, the interior wall of the cylinder housing 13 retains it in the cut 94. Note also in FIG. 14 that the bitting on the key bit 91 has positioned all of the tumbler pin interfaces in alignment with the shear plane 52 so that the core 12 can be rotated within the cylinder housing 13.

When the core 12 is rotated to the position shown in FIG. 15 so the cut 94 is aligned with top pin chamber 18, the leaf spring 95 forces spacer member 51 into top pin chamber 18 against the bias of pin spring 44. As mentioned above, the leaf spring 95 is inherently stronger than pin spring 44 so that it is capable of pushing the spacer member 51 out of cut 94 and into the pin chamber 18. Leaf spring 95 is also shaped such that its distal end only extends upwardly in cut 94 to a position flush with the edge of the key bit 91 so that it does not protrude through shear plane 52. Therefore, the leaf spring 95 is effective to position spacer member 51 into the top pin chamber 18 with its bottom surface aligned with shear plane 52. Then, the core 12 can be rotated back 180° to realign the top and bottom pin chambers with each other so that the key bit 91 of the rekeying device 90 can be removed from the core 12 leaving the lock rekeyed.

Of course, a plurality of spacer members can be positioned in one or more pin chambers in any combination desired with this rekeying device as long as appropriate bitting is provided to rotate the core. Therefore, a large number of rekeying possibilities exist. In fact, if rekeying devices for removing spacer members, such as the device 70 shown in FIG. 3, are used in combination with rekeying devices for inserting spacers, such as that shown in FIG. 13, a tumbler pin cylinder lock can be rekeyed almost indefinitely without having to disassemble the lock.

Another advantage of rekeying locks according to this invention is that the operator can always know positively that the lock has been successfully rekeyed. In rekeying by removing a spacer member, the spacer member is pulled out the front of the core where it can be seen. When the spacer member is pulled out, the operator can see that the lock has been rekeyed. On the other hand, in rekeying by inserting a spacer member into the pin chamber, when the rekeying device is pulled out of the core without the spacer member, the operator will know that the lock has been rekeyed. There is no place for the spacer member to go in the lock other than into the pin chamber.

Although the present invention has been described with a certain degree of particularity, it is understood that the present disclosure has been made for clarity and example and that changes in details of structure may be made without departing from the scope of the claims hereof.

What I claim is:

1. In rekeyable lock apparatus, including a lock cylinder housing with a cylindrical bore extending longitudinally therethrough and an elongated top pin chamber in said housing perpendicular to and extending radially outward from said cylindrical bore, a cylindrical core positioned rotatably in said bore, said core having a longitudinal keyway therein for receiving a key bit and a bottom pin chamber extending radially inward from the peripheral surface thereof into said keyway, said bottom pin chamber being adapted to axially align with said top pin chamber when said core is positioned in said cylindrical bore in such a manner that said top and bottom pin chambers form a common pin chamber, a top tumbler pin slideably positioned in said top pin chamber and a bottom tumber pin slideably positioned in said bottom pin chamber, said core being rotatable when the interface between said top and bottom pins is aligned with the shear plane between the core and the cylinder housing and not being rotatable when a pin is positioned through said shear plane, the improvement comprising:

spacer means positioned in said bottom pin chamber between said top pin and said bottom pin for providing an additional interface between said top and bottom pins adapted for alignment with the shear plane between said core and said cylinder housing, one interface being on the top of said spacer means and a second interface being on the bottom of said spacer means;

removal means for removing said spacer means from said pin chamber and ejecting it out of said lock apparatus; and insertion means for inserting said spacer means into said pin chamber.

2. In rekeyable lock apparatus, including a lock cylinder housing with a cylindrical bore extending longitudinally therethrough and an elongated top pin chamber in said housing perpendicular to and extending radially outward from said cylindrical bore, a cylindrical core positioned rotatably in said bore, said core having a longitudinal keyway therein for receiving a key bit and a bottom pin chamber extending radially inward from the peripheral surface thereof into said keyway, said bottom pin chamber being adapted to axially align with said top pin chamber when said core is positioned in said cylindrical bore in such a manner that said top and bottom pin chambers form a common pin chamber, a top tumbler pin slideably positioned in said top pin chamber, said core being rotatable when the interface between said top and bottom pins is aligned with the shear plane between the core and the cylinder housing and not being rotatable when a pin is positioned through said shear plane, the improvement comprising;

spacer means adapted to be positioned in said pin chamber for providing an additional interface between said top and bottom pins for alignment with the shear plane between said core and said cylinder housing, and insertion means for inserting said spacer means into said pin chamber between said top and bottom pins.

3. The rekeyable lock apparatus of claim 2, wherein said insertion means includes an elongated key bit adapted for insertion into said keyway and having a bitting thereon adapted to position said interface between said top pin and said bottom pin in alignment with the shear plane between said core and said cylinder housing such that said core can be rotated within said cylinder housing, said key bit also having a cut therein opposite said bitting and adapted to receive said spacer means therein and ejection means for forcing said spacer means out of said cut and into said top pin chamber when said cut is aligned with said top pin chamber.

4. The rekeyable lock apparatus of claim 3, wherein said ejection means includes a spring positioned in said cut.

5. A re-keying device for inserting spacers between the top and bottom pins in the pin chambers of tumbler pin locks, comprising:

a key bit having bitting thereon adapted for aligning the interfaces between top and bottom tumbler pins with the shear plane between the core and the cylinder housing of the lock so that the core can be rotated, a cut therein opposite said bittings and spaced to align with a pin chamber and for containing a spacer therein, and ejection means for pushing said spacer out of said cut and into said pin chamber.

6. The re-keying device of claim 5, wherein said ejection means includes a spring in said cut.

7. The re-keying device of claim 6, wherein the strength of said spring in said cut is strong enough to push said spacer into said pin chamber against the bias of tumbler pin springs in the lock.

8. In lock apparatus having a lock cylinder housing with a cylindrical bore extending longitudinally therethrough and an elongated top pin chamber in said housing perpendicular to and extending radially outward from said cylindrical bore, a cylindrical core positioned rotatably in said bore, said core having a longitudinal keyway therein for receiving a key bit and a bottom pin chamber extending radially inward from the peripheral surface thereof into said keyway, said bottom pin chamber being adapted to axially align with said top pin chamber when said core is positioned in said cylindrical bore in such a manner that said top and bottom pin chambers form a common pin chamber, a top tumbler pin slideably positioned in said top pin chamber and a bottom tumbler pin slideably positioned in said bottom pin chamber, said core being rotatable when the interface between said top and bottom pins is aligned with the shear plane between the core and the cylinder housing and not being rotatable when a pin is positioned through said pin chamber between said top and bottom pins, the method of rekeying said lock apparatus comprising the steps of:

inserting into said keyway a key bit having bitting thereon adapted to position the interface in alignment with said shear plane so the core can be rotated and having a cut therein opposite said bitting containing a spacer member;

rotating said key bit and core in said housing to align said cut with said top pin chamber and ejecting said spacer member out of said cut and into said top pin chamber.

* * * * *